US005695004A

United States Patent [19]

Beckwith

[11] Patent Number: 5,695,004

[45] Date of Patent: Dec. 9, 1997

[54] AIR CONDITIONING WASTE HEAT/REHEAT METHOD AND APPARATUS

[76] Inventor: William R. Beckwith, 15818 Hampton Village Dr., Tampa, Fla. 33618

[21] Appl. No.: 159,669

[22] Filed: Nov. 30, 1993

Related U.S. Application Data

[63] Continuation-in-part of Ser. No. 911,516, Jul. 10, 1992, Pat. No. 5,265,433.

[51] Int. Cl.[6] ..... F28D 15/02

[52] U.S. Cl. ..... 165/104.21; 165/104.14

[58] Field of Search ..... 165/104.14, 104.21, 165/32; 62/90, 93

[56] References Cited

U.S. PATENT DOCUMENTS

| | | | |
|---|---|---|---|
| 3,298,431 | 1/1967 | Weaver | 165/32 |
| 3,543,839 | 12/1970 | Shlosinger | 165/32 |
| 4,607,498 | 8/1986 | Dinh | 165/104.21 X |
| 4,971,139 | 11/1990 | Khattar | 165/86 |
| 5,159,972 | 11/1992 | Gunnerson et al. | 165/32 |
| 5,333,470 | 8/1994 | Dinh | 165/104.14 X |

FOREIGN PATENT DOCUMENTS

| | | | |
|---|---|---|---|
| 56-119492 | 9/1981 | Japan | 165/104.14 |
| 58-13947 | 1/1983 | Japan | 165/32 |
| 59-1998 | 1/1984 | Japan | 165/32 |
| 63-318492 | 12/1988 | Japan | 165/104.14 |
| 82/03680 | 10/1982 | WIPO | 165/104.21 |

*Primary Examiner*—Harry B. Tanner

[57] ABSTRACT

An air conditioning system comprising a compressor, condenser and evaporator as functioning components in a primary loop for moving a working fluid in a continuous and automatic cycle of operation between such components. The system includes a plurality of zones through which the air to be conditioned is moved. The zones each include stacked horizontal tubes in a single coil with vertical heat exchanging fins in a parallel array with the tubes of each stack extending through the fins. A wrap-around heat pipe with first parallel tubes adjacent to the input of such zones and with second parallel tubes adjacent to the output of such zones and parallel horizontal lines coupling the first and second parallel tubes.

6 Claims, 12 Drawing Sheets

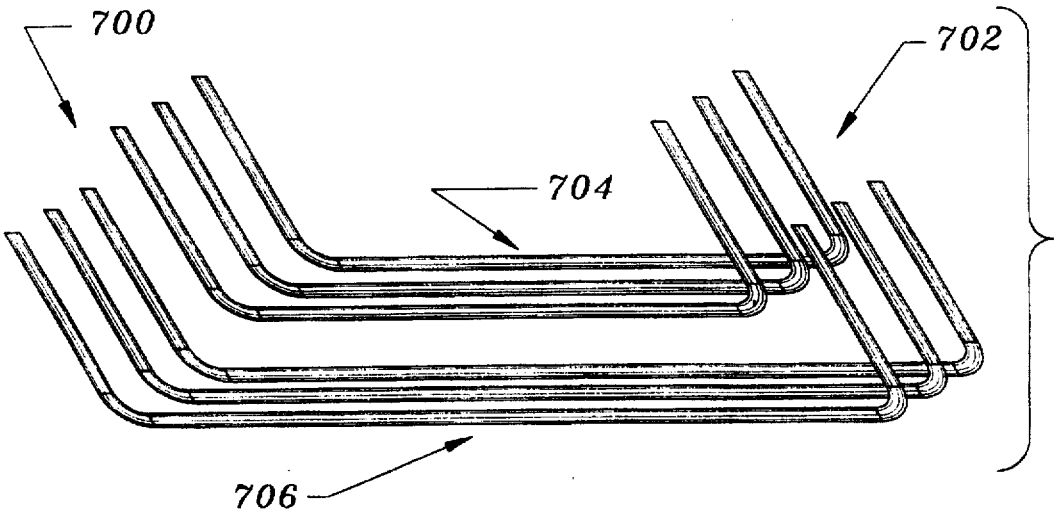
FIG. 12
FIG. 12A
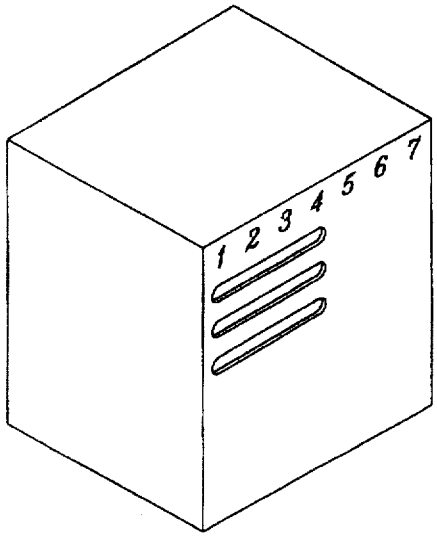
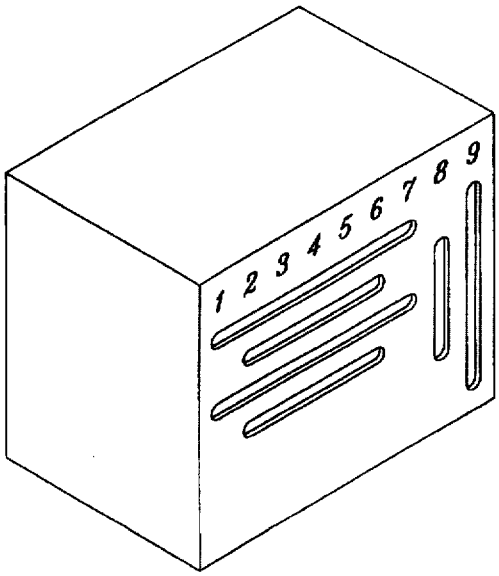
FIG. 12B

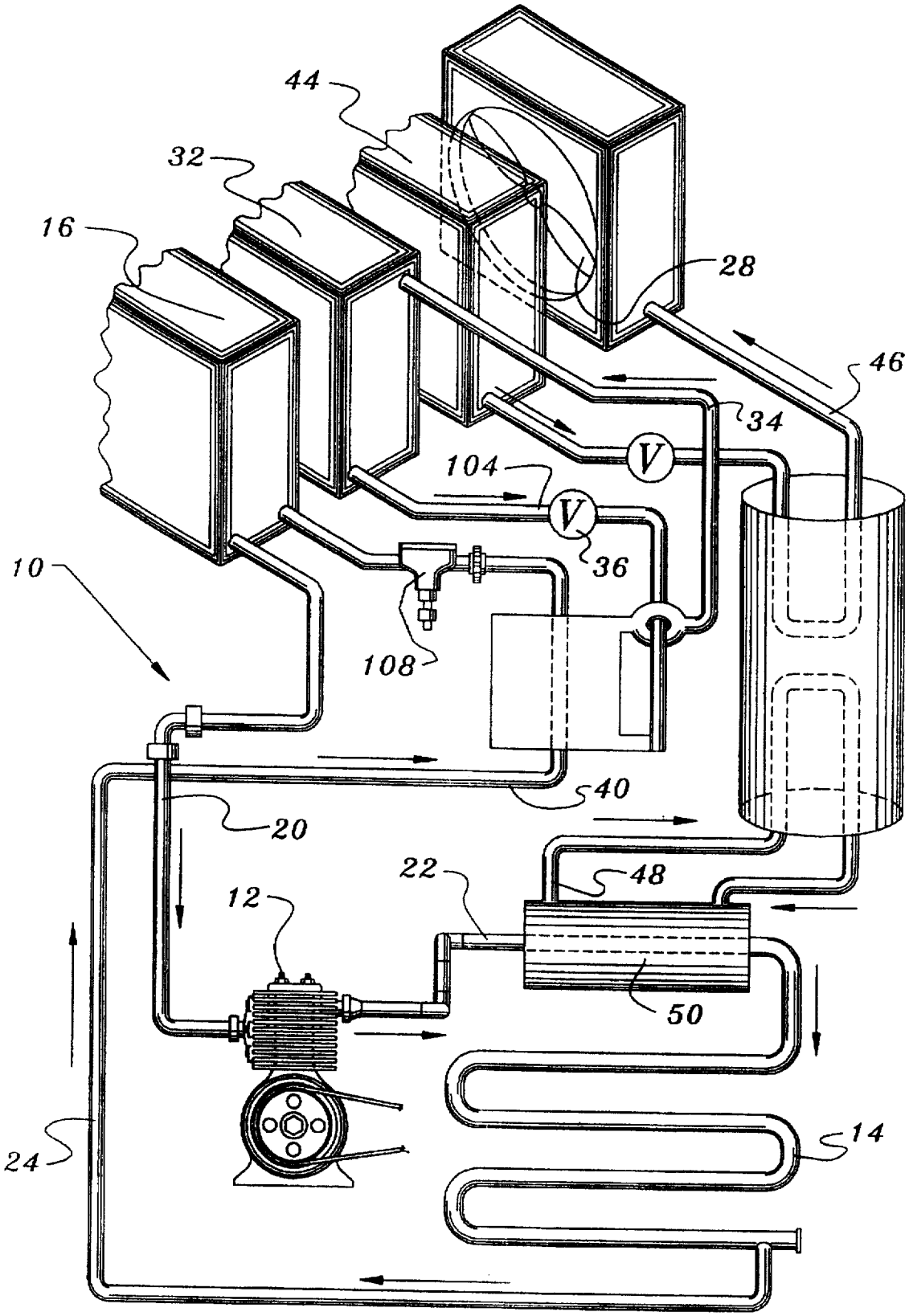
44
32
16
28
46
34
V
104
V
36
10
108
40
20
22
48
12
50
14
24

AIR CONDITIONING WASTE HEAT/REHEAT METHOD AND APPARATUS

RELATED APPLICATION

This application is a continuation-in-part application of U.S. patent application Ser. No. 07/911,516, filed Jul. 10, 1992 now U.S. Pat. No. 5,265,433.

BACKGROUND OF THE INVENTION

1. Field of the Invention

This invention related to a waste heat/reheat method and apparatus and, more particuarly, to a method and apparatus for utilizing heat energy from the refrigeration cycle to heat the working fluid of an air conditioning system at the post compressor and/or post condensor region.

2. Description of the Background Art

In the field of air conditioning systems, a working fluid such as freon, alcohol or similar fluids capable of changing state under different conditions of temperature and pressure for accepting heat energy and giving up heat energy. In a conventional air conditioning system, the working fluid moves in a cycle of operation between an evaporator generally inside the building to be cooled whereat the working fluid is converted from a liquid to a gas and air passing therethrough is cooled. The working fluid then moves from the evaporator to a compressor. The compressor is normally outside and functions to compress the working fluid. The working fluid through the compressor is a low temperature gas at about 65° whereupon it leaves at a high temperature gas at about 150°. Movement of the working fluid is then from the compressor to the condenser and then back to the evaporator. The condenser, normally outside, functions to convert the received gas to a liquid with temperature moving from about 150 to about 90 degrees.

In some air conditioning systems, the air moving through the evaporator is reheated. It is standard practice to overcool the air moving through the evaporator taking it from about 80 degrees to about 55 degrees to ring out the moisture so that the cooling is simply done to the air and not to the liquid. Such cooling through the evaporator normally takes the air to a cooler than desired temperature but this assists in the efficient dehumidifying of the cooled air. In essence, then the evaporator overcools the air and tends to ring out the moisture. The reheater then dehumidifies to a comfortable level for humans and at the same time lowers the relative humidity.

Limited efforts have been made in the past to reheat the post evaporator air to make it more comfortable. Efforts in the past have also been directed to utilizing the heating of the air at the reheater and to cool various parts of the conventional air conditioning system as through heat pipe technology. Nothing in the prior art, however, suggests the utilizing of heat pipe technology for reheating in combination with post compressor and/or post condenser cooling without cut in to the existing system. By way of example, U.S. Pat. Nos. 2,111,618 to Erbach and 2,291,029 to Everett disclose the utilization of heat pipe technology post evaporator for cooling the refrigerant post compressor only. Heat pipe technology is also utilized in U.S. Pat. Nos. 2,214,057 to Hall; 4,607,498 to Dinh and 4,971,139 to Khattar. In these references, however, the heat pump technology is used to transfer heat from return air to supply air. A third body of art as exemplified by U.S. Pat. Nos. 1,837,798 to Shiplee; 2,154,136 to Parcaro; 2,734,348 to Wright; 2,932,178 to Armstrong; 3,026,687 to Robson and 3,123,492 to McGrath.

These patents all use non heat pipe technology for transferring heat in an air conditioning system from one location to another but require supplemental utilization to effect the secondary flow of fluids.

None of the prior art inventions disclose the utilization of heat pipe technology for minimum supplemental energy requirements to transfer the heat post evaporator to post compressor and/or post evaporator locations for maximizing the efficiency of the system. The present invention effects its objects and advantages with minimum cost and utilizes only readily available materials in a system's configuration for retro-fitting air conditioning systems without cut-ins or can be used for the generation of a most efficient air conditioning system through the application of the methods and apparatuses of the present invention.

Therefore, it is an object of this invention to provide an apparatus which overcomes the aforementioned inadequacies of the prior art devices and provides an improvement which is a significant contribution to the advancement of the prior art.

Accordingly, it is the object of this invention to provide an air conditioning system comprising a compressor, condenser and evaporator as functioning components in a primary loop for moving a working fluid in a continuous and automatic cycle of operation between such components, the system including a plurality of zones through which the air to be conditioned is moved, the zones each including stacked horizontal tubes in a single coil with vertical heat exchanging fins in a parallel array with the tubes of each stack extending through the fins.

It is a further object of the present invention to utilize post evaporated reheat energy to cool an air conditioning refrigerant at a post condenser location.

It is a further object of the present invention to utilize reheat energy to cool a conventional air conditioning refrigerant at a post compressor location.

It is a further object of the present invention to use plural reheat energies to cool the refrigerant of a conventional air conditioning system at both the post compressor and post condenser locations.

It is a further object of the present invention to cool refrigerant of a conventional air conditioning system without the disruption or cutting-in to the existing air conditioning system.

It is a further object of the present invention to use heater/thinned pipes as the reheater of an air conditioning system for maximizing heat transfer and energy utilization for cooling at post compressor and post condenser locations.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an air conditioning system comprising a compressor, condenser and evaporator as functioning components in a primary loop for moving a working fluid in a continuous and automatic cycle of operation between such components, the system including a plurality of zones through which the air to be conditioned is moved, the zones each including stacked horizontal tubes in a single coil with vertical heat exchanging fins in a parallel array with the tubes of each stack extending through the fins.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIGS. 7, 8, 9, 10, 10A, 10B, 11, 11A, 12, 12A and 12B, 13 and 13A illustrate alternate embodiments of the invention.

Similar reference characters refer to similar parts throughout the several views of the drawings.

DETAILED DESCRIPTION OF THE PREFERRED EMBODIMENT

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Figure 1:
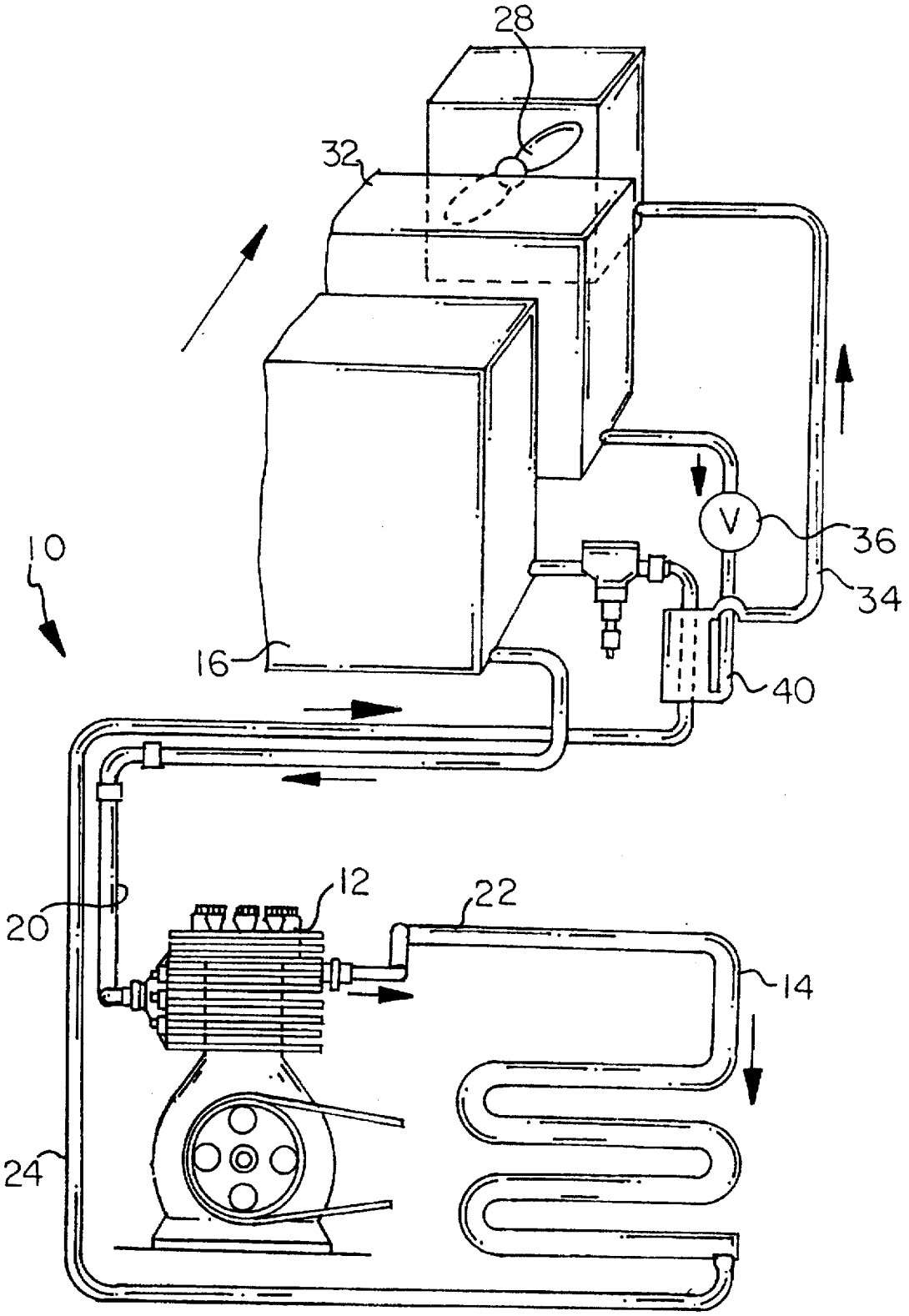
FIG. 1 is a partially schematic illustration of a post condenser cooling system coupled with a post evaporator reheater.

Shown in the various figures are three embodiments of the present air conditioning system 10. In the FIG. 1 embodiment, there is shown a conventional air conditioning system 10 in association with the improvements of the present invention. The basic air conditioning system of FIG. 1 is the same for the embodiments of FIGS. 2 and 3. In accordance with these embodiments, the basic air conditioning system has three major components.

These three system components include the compressor 12, condenser 14 and evaporator 16. The air conditioning system moves a working fluid, preferably freon, by conventional pipes 20, 22 and 24 through these operational components in a continuous and automatic cycle of operation. The working fluid may also be other fluids such as alcohol or the like capable of accepting and giving up heat energy as its temperature increases and decreases and as its state changes between gas and liquid.

At the compressor 14, the working fluid enters through a line 20 as a low temperature gas at about 65 degrees Fahrenheit and is compressed to leave through a line as a high temperature gas at about 150 degrees Fahrenheit. The compressor is normally outside the building to be cooled.

The working fluid them moves in its gaseous state through a line 22 to the condenser 14, normally outside the building to be cooled. At the condenser, the received gas, at about 150 degrees Fahrenheit, decreases in temperature and becomes a liquid at about 90 degrees Fahrenheit. Thereafter, a line 24 directs the liquid working fluid to the evaporator 16.

The evaporator is inside the building to be cooled. At the evaporator, the received liquid, at about 90 degrees Fahrenheit, is cooled as it expands to a gas of about 45 degrees Fahrenheit. At the evaporator, the air to be cooled is, for example, initially at about 80 degrees Fahrenheit. Such air is moved by a fan 28 through the evaporator and becomes cooled to about 50 to 55 degrees Fahrenheit or lower. The lines 20, 22 and 24, in combination with the compressor 12, condenser 14 and evaporator 16 define a primary loop.

In accordance with the FIG. 1 embodiment, a reheater 32 is provided to intercept the cooled air following the evaporator 16. The reheater functions to heat the cooled air from about 50 to 55 degrees Fahrenheit to a more comfortable elevated temperature of about 60 to 70 degrees Fahrenheit. The reheater includes a closed line 34 and a valve 36 and functions to convert the nonuseful heat energy into useful energy. More specifically, the supplemental closed line 34 contains a working fluid, the same or similar to that in the primary conventional air conditioning loop. The working fluid of the secondary loop may also be water. The fluid functions to heat the air as it condenses from a gas to a liquid in its reheater. The liquified working fluid in the reheater then moves from the top of the reheater through a line by gravity to a jacket 40 sealingly secured around the post evaporator line of the primary air conditioning loop. Line 34 with reheater 32 and jacket 40 define a secondary loop. At the jacket, heat from the post evaporator line is transferred to the working fluid of the primary line to vaporize the fluid to a gas. The gas then moves to the top of the reheater to heat the post evaporator air and then moves in a continued cycle to cool the post condenser gases. The fluid of this secondary loop changes at the reheater from a gas to a liquid at about 72 degrees Fahrenheit and from a liquid to a gas at about 72 degrees Fahrenheit at the post condenser zone.

No pumps are needed to effect the desired movement of working fluid in the secondary or reheater loop. Movement is effected through heat-pipe technology. By this it is meant that in the jacket, as the working fluid absorbs heat and changes from a liquid to a vapor, it is thermodynamically driven to the reheater because of the temperature and pressure differentials which exist between the jacket and reheater. The vapor in the jacket creates a high pressure and the condensation of the gas to a liquid in the reheater creates a low pressure. The vapor will travel from the high pressure to the low pressure. After condensing in the reheater, the liquified working fluid flows by gravity to the jacket.

Figure 2:
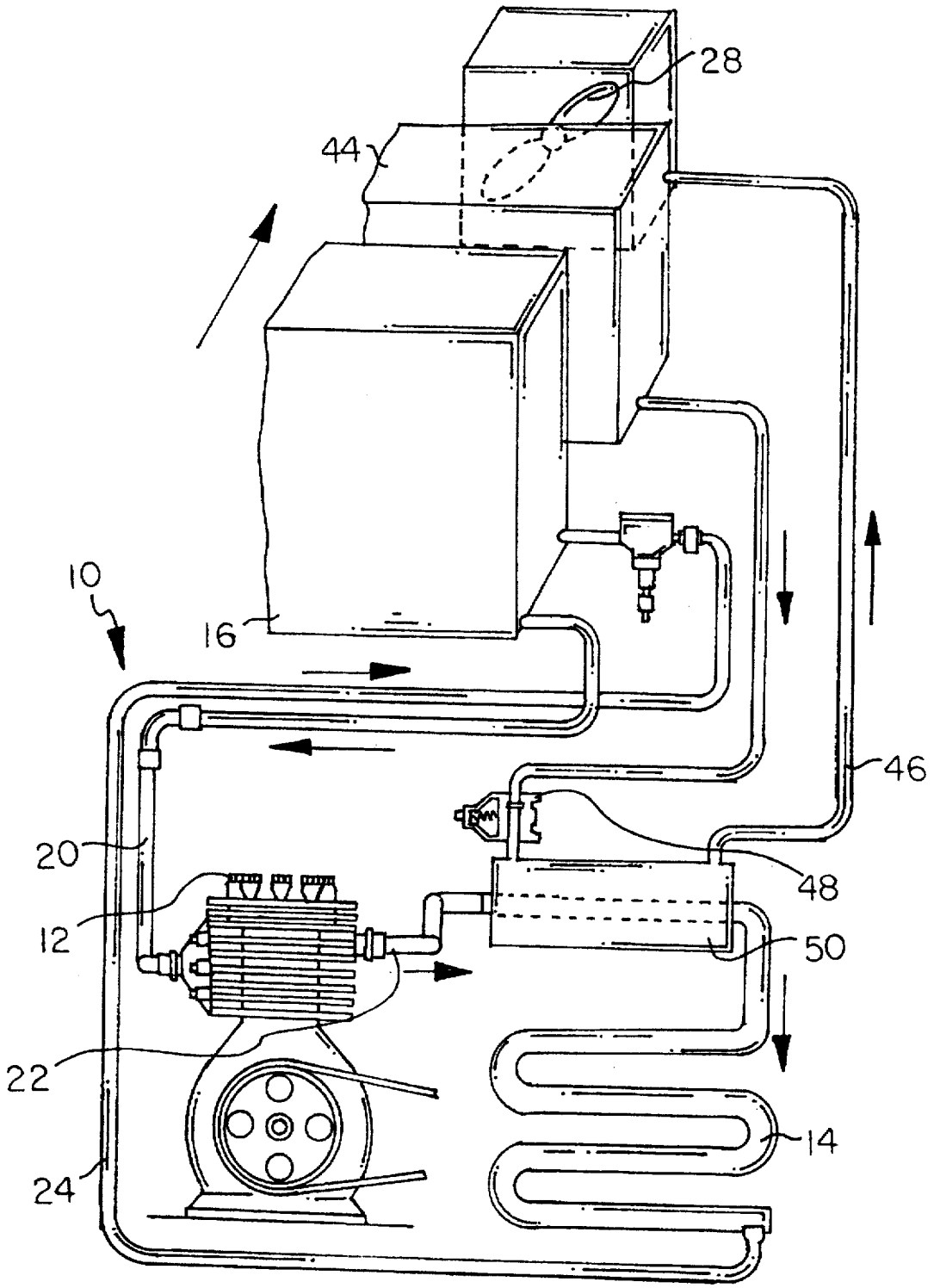
FIG. 2 is a post compressor cooling arrangement coupled with a post evaporator reheater.

In accordance with the FIG. 2 embodiment, a reheater 44 is provided to intercept the air following the evaporator 16.

The reheater functions to heat the cooled air from about 50 to 55 degrees Fahrenheit to a more comfortable elevated temperature of about 60 degrees Fahrenheit or higher. The reheater includes a closed line 46, and a valve 48 and functions to convert the waste heat energy into useful energy. The primary loop is essentially the same as that of the first embodiment of FIG. 1, more specifically, the supplemental closed line 46 contains a working fluid, the same or similar to that in the primary conventional air conditioning loop. The fluid functions to heat the air as it condenses from a gas to a liquid in its reheater. The liquified working fluid in the reheater then moves through a line by gravity to a jacket 50 around the post compressor line of the primary air conditioning loop. At the jacket, heat from the post condenser line is transferred to the working fluid to vaporize the fluid to a gas. The gas then moves to the reheater 44 to heat the post evaporator air and then moves to the bottom of the reheater in a continuing cycle to cool the post condenser gases. The fluid of this second cycle changes at the reheater 44 from a gas to a liquid at about 102 degrees Fahrenheit at the post compressor zone.

Figure 3:
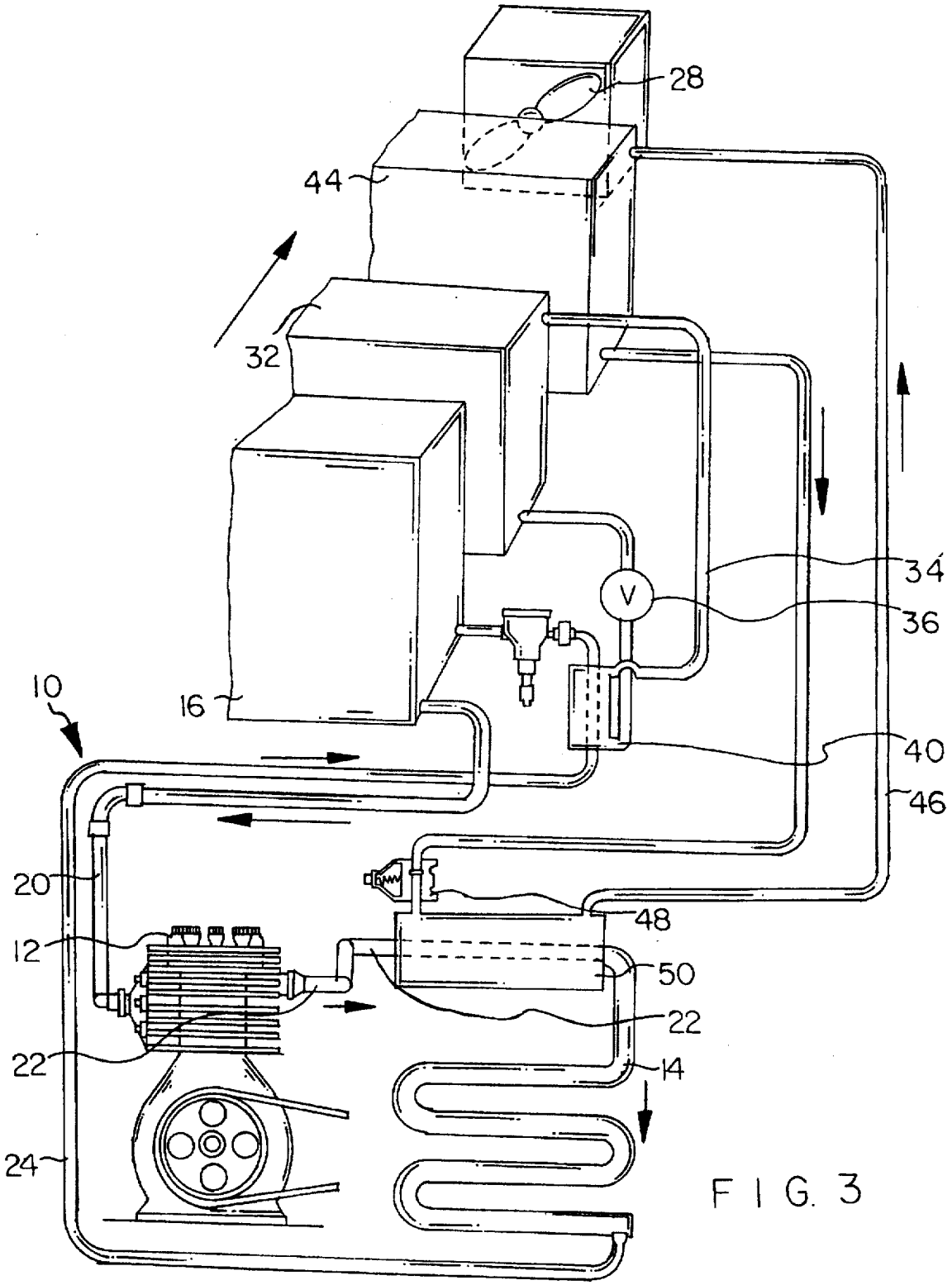
FIG. 3 is a partial schematic of an air conditioning system employing two reheaters, one coupled for cooling at the post condenser location and the second reheater coupled for cooling at the post compressor location.

In the FIG. 3 embodiment, the reheating of the post evaporator air is used to cool the post condenser working fluid of the primary loop as in FIG. 1 and the post compressor working fluid of the primary loop as in FIG. 2. The primary loop is essentially the same as in the first and second embodiments of FIGS. 1 and 2. As a result, the heating of the post evaporator air goes from about 50 to 55 degrees Fahrenheit immediately prior to the primary reheater 32 to about 60 degrees Fahrenheit prior to the secondary reheater 44 and emerges for use at about 70 degrees Fahrenheit or higher. Lines 34 and 46 extend from the primary and secondary reheaters to the lines 24 and 22 at the post condenser zone and the post compressor zone. Temperatures and working fluid states at these various stages are similar to the FIG. 1 and FIG. 2 embodiments. Each secondary loop functions independently of the other secondary loop.

The two secondary loops functioning together will provide improved dehumidification throughout the entire year. When the post condenser refrigerant in the conventional air conditioning system is cooled, the evaporator will remove more moisture from the air passing through it. Then the air is reheated by the reheater. Because the conventional air conditioning system does not operate under conditions of low heat load (i.e. spring and fall), the second reheater coupled to the post compressor line will provide a free heat load to cause the entire system to operate and provide dehumidification.

The valves 36 and 48 of the secondary loops can each function independently of the other for opening and closing its associated line as a function of temperature, humidity, time, pressure or the like, all in a conventional manner. When, however, used together in the FIG. 3 embodiment, they function in synergism. Valve 36 is preferably controlled by a humidistat, and valve 48 is preferably controlled by a thermostat. Working together in this manner, they provide temperature and humidity control through the year regardless of the heat load.

Recent studies of indoor air quality have indicated that microbiological contamination (i.e. mold and bacteria) is a serous health threat to human beings. In fact, the World Health Organization has identified microbial contamination as number five of the top five health threats to human beings in buildings. The only practical way to control microbial contamination in a building is to control the humidity. Without moisture, these organisms cannot survive.

Figure 4:
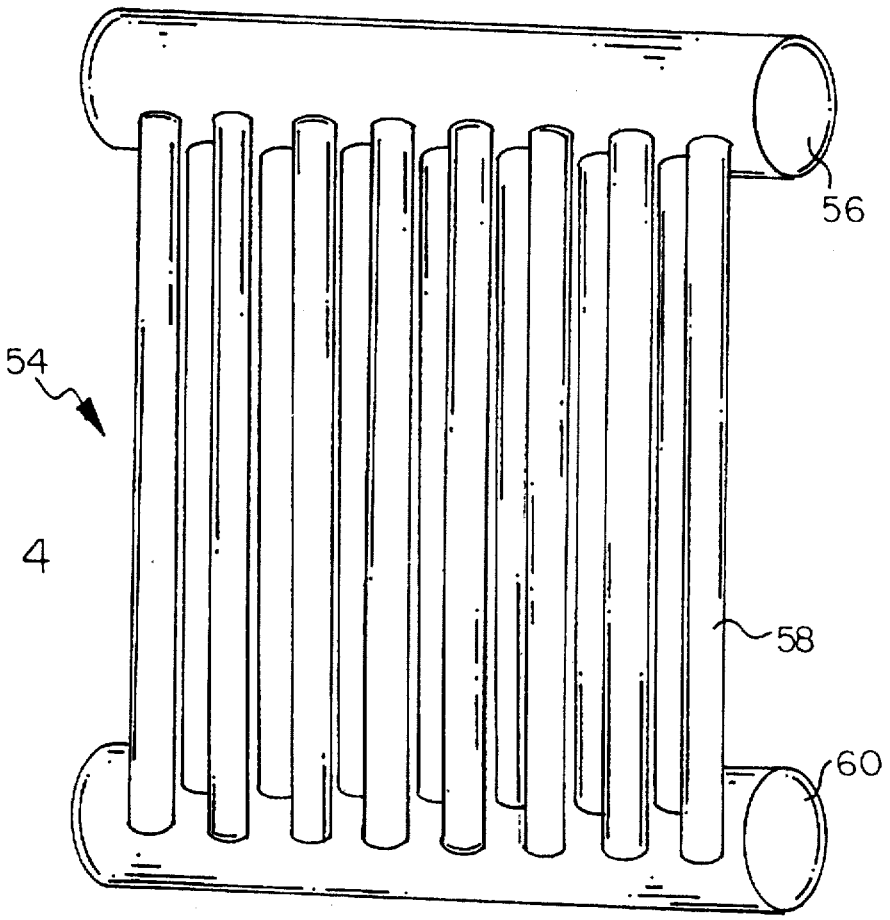
FIGS. 4, 5 and 6 are schematic illustrations of a typical reheater shown in FIGS. 1 and 2.
Figure 5:
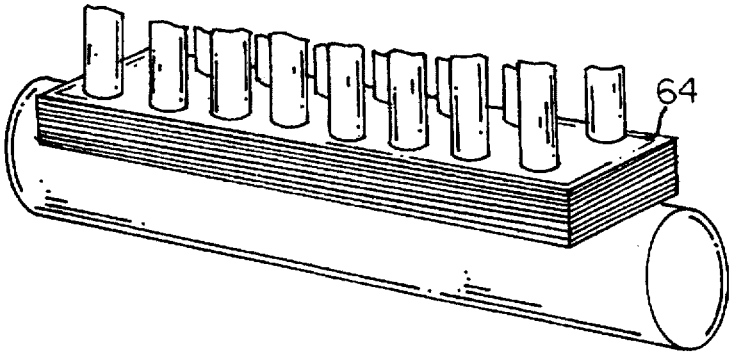
Figure 6:
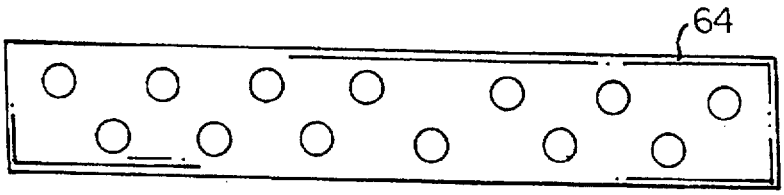

Lastly, in the illustrations of FIGS. 4, 5 and 6, an improved reheater 54 is provided. Features of the reheater shown in the Figures include a primary or upper header 56 for receiving the vapor from a line of one of the secondary reheater loops. The upper header 54 for each loop receives all of the gases from the post condenser and post compressor zones, respectively. The received heated working fluid in a gaseous state then passes downwardly through a plurality of parallel heat exchange pipe 58 to the lower or secondary header 60. The heat exchange pipes are provided with spaced fins 64 along their entire lengths. The fins are preferably in the form of aperture plates with offset holes for receiving the offset pipes. Thereafter, the received gases of the working fluid are cooled to the liquid state and moved to the post condenser and post compressor zones, respectively. Such an arrangement effects a most efficient heating of the post evaporator air and cooling of the working fluid.

In carrying out the method of the present invention, an air conditioning method comprises the steps of providing a compressor, condenser and evaporator with a primary loop for moving a working fluid in a continuous and automatic cycle of operation between such components. The method further includes the step of providing a first reheater located subsequent to the evaporator for heating the post evaporator air with a first supplemental loop coupling the first reheater to the post condenser line. The method further includes the step of providing a second reheater located subsequent to the first reheater with a second supplemental loop coupled with the post compressor line. The method further includes the step of moving a working fluid through the primary and two supplemental loops in a continuous cycle of operation. The first supplemental loop includes a jacket surrounding the associated line of the primary loop. The second supplemental includes a jacket surrounding the associated line of the primary loop. It should be understood that the method may include the use of the two reheaters with their associated jackets or, in the alternative, either one of the two reheaters and its associated jacket as a function of the particular application.

Figure 7:
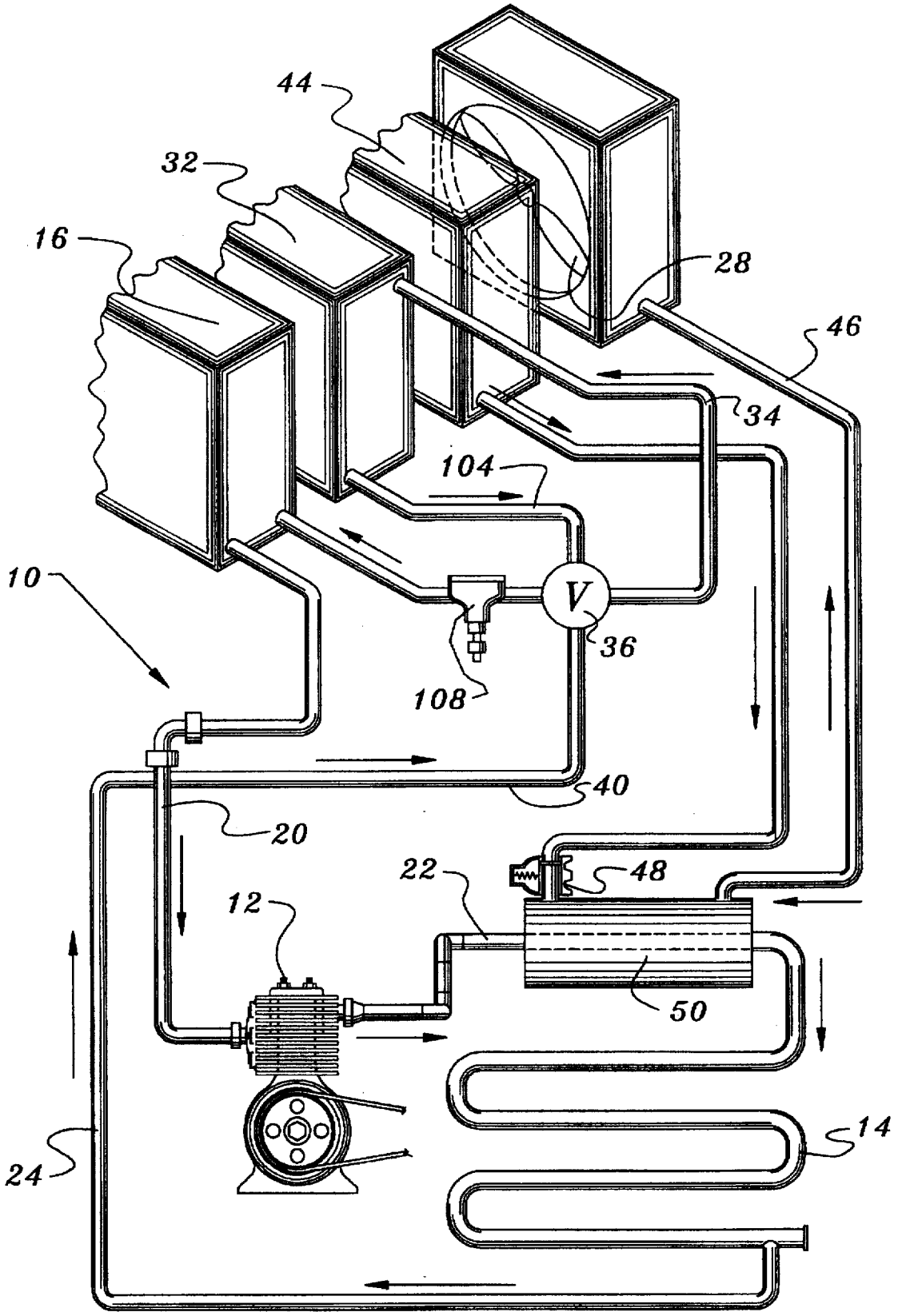

The embodiment shown in FIG. 7 is similar to that embodiment of FIG. 2. In such embodiment, there is a sub-cooling reheat loop 24 which will be referred to as loop one. There will also be a de-super heating reheat loop 46 which will be referred to as loop two. In the FIG. 7 embodiment, the first change made to the pipes is in liquid line 24 of the refrigeration system. Such line directs working fluid to and through a valve 100. In one orientation of the valve, the valve takes the working fluid through line 102 to a coil 32 in the same position as the reheat coil of the sub-cooling reheat loop. However, the liquid of refrigerant is piped through this coil, then through line 104 back through valve 100 and then through line 106. There the refrigerant flows through a metering device 108 and into the evaporator 16. An alternate flow pattern for the working fluid is created by repositioning the valve 100 so as to direct the liquid refrigerant in line 24 through valve 100 and into line 106 thereby bypassing the reheat coil 32.

Figure 8:
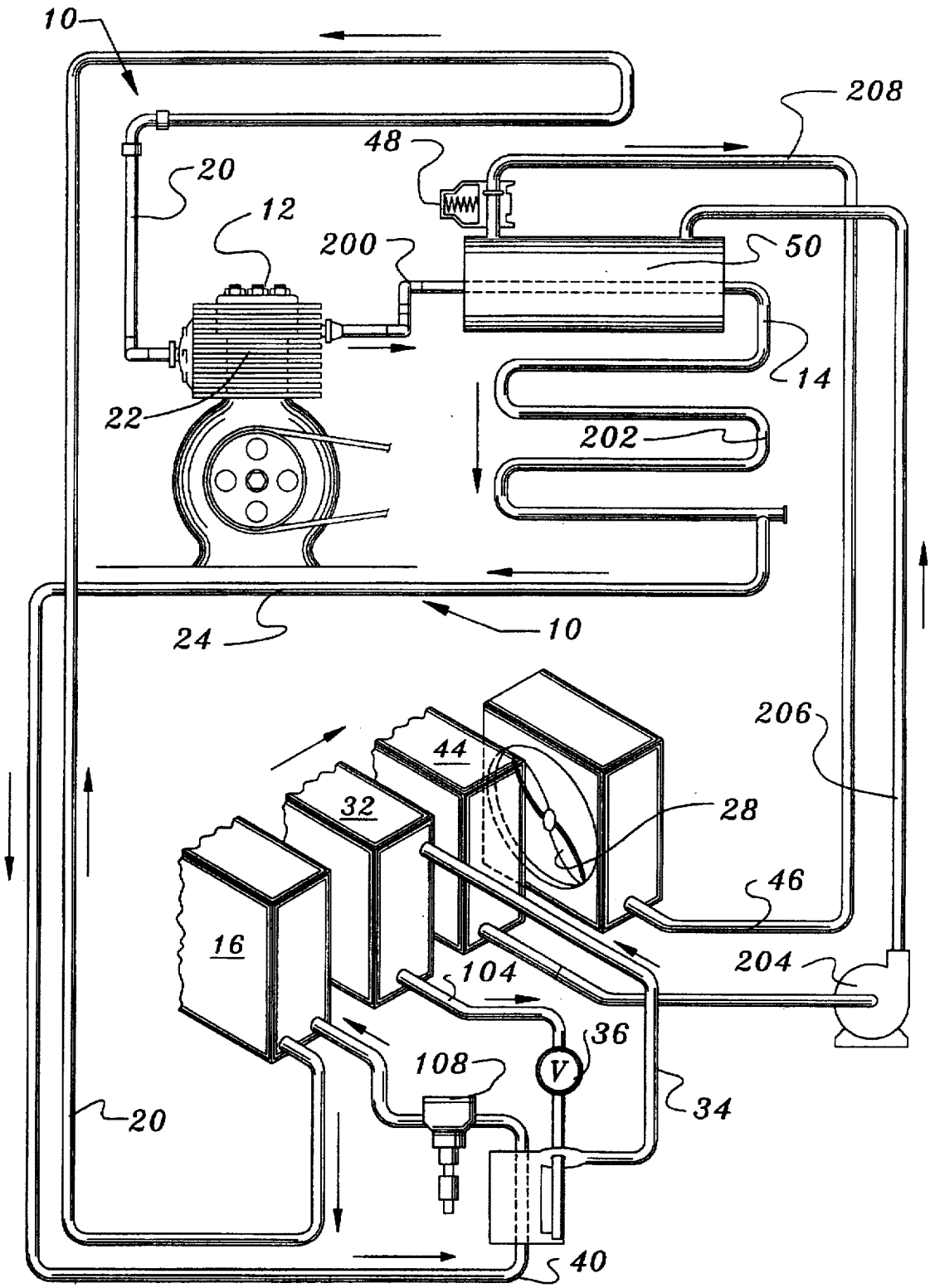

FIG. 8 illustrates an other alternate embodiment of the invention. In this embodiment, the hot gas discharge line 200 is located above the reheat coil 44. In this case a pump 204 is used to pump the liquid refrigerant after it is condensed in reheat coil 44 up through a line 206 back to the heat exchanger 50 for vaporization in the heat exchanger. Line 208 completes the cycle.

Figure 9:
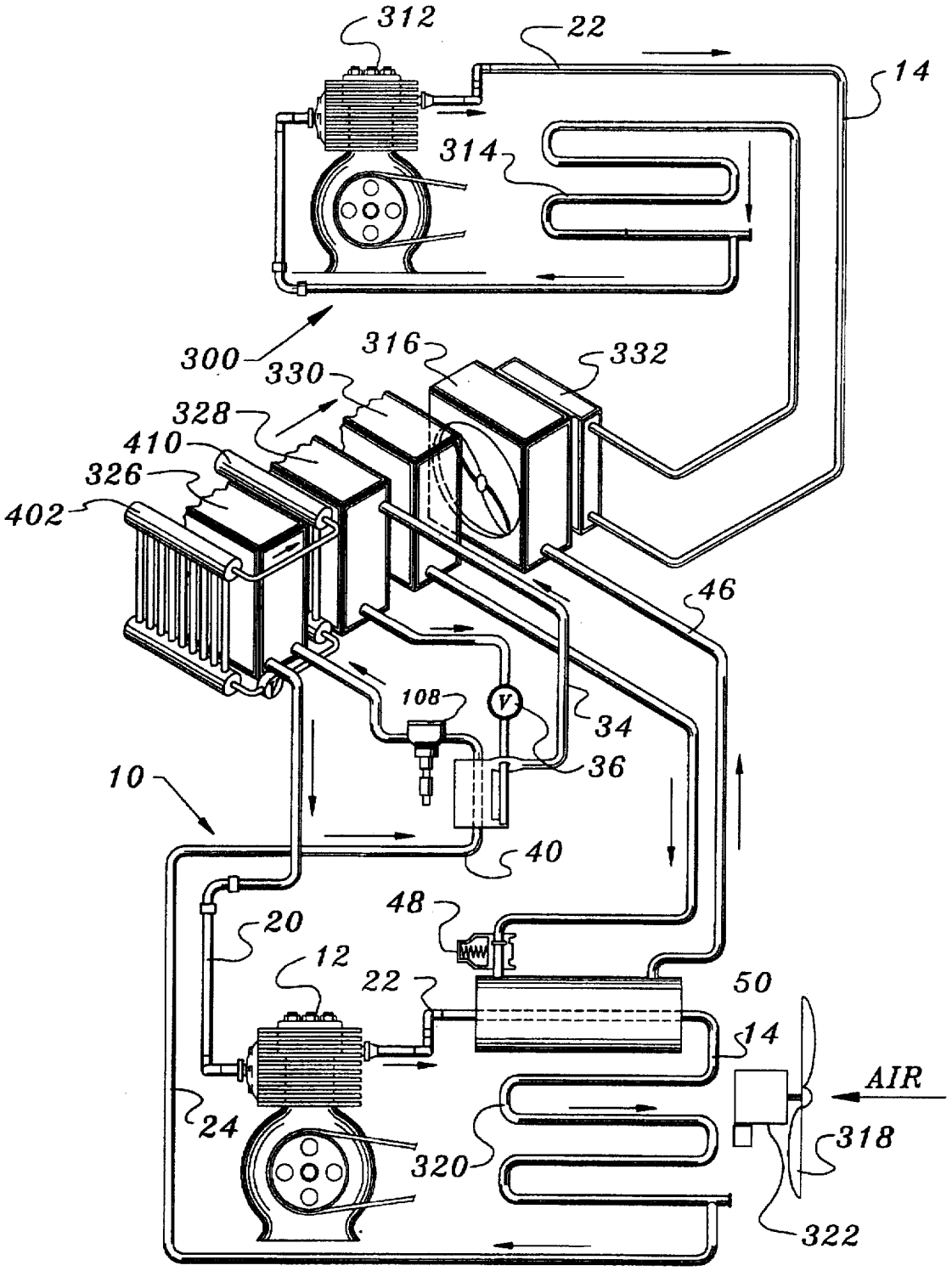

FIG. 9 is an alternate embodiment of the invention which combines a wrap-around heat pipe in the direct expansion (DX) cooling equipment for combining a wrap-around heat pipe with a sub-cooling and de-super heat/reheat (SCADR) system. This enables the treatment of 100 percent outside air using DX equipment. In this system, the wrap-around heat pipe is more fully described in FIG. 10 hereinafter. It includes all of the various combinations of waste heat/reheat of FIGS. 3 and/or 7. In addition, there is added a last stage of reheat using a reverse cycle air conditioner 300 in the heating mode. This includes a conventional compressor 312, condenser 314 and a new evaporator 316. When, however, operating in a reverse cycle as shown by the arrows of FIG. 9, the evaporator 316 performs as a condenser while condenser 314 performs as an evaporator. Lastly, an air fan 318 directs a flow of air across condenser 320. Controller 322 varies the fan's speed as a function of relative humidity, temperature or pressure. Such is generally conventional. But in the present embodiment, in conjunction with the present waste heat/reheat method and apparatus, not only is the control of the capacity maintained, control is maintained and a method is provided to vary the amount of reheat provided by the sub-cooling reheating. The other components of this system are the same as in the prior embodiment unless otherwise specified.

Further with regard to FIG. 9, there are shown the components of the wrap-around heat pipe 402, 410 as well as the direct expansion evaporation cooler 326, the sub cooling reheat coil 328, the de-super heat/reheat coil 330 and the heat pump 332 all in alignment for the passage of air therethrough for effecting the appropriate heating and cooling. The fan 28 effects the flow of air in its path of travel.

Figure 10:
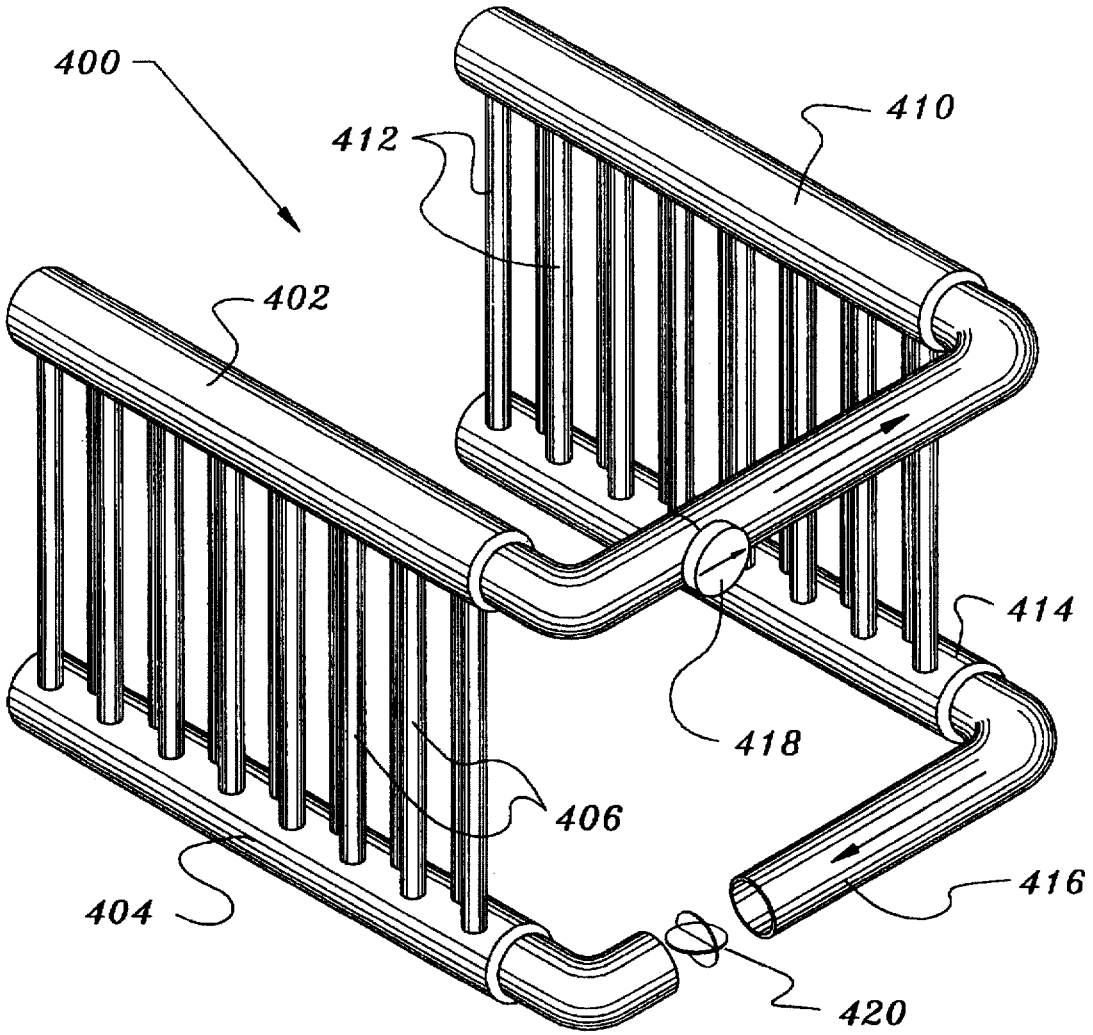
Figure 10A:
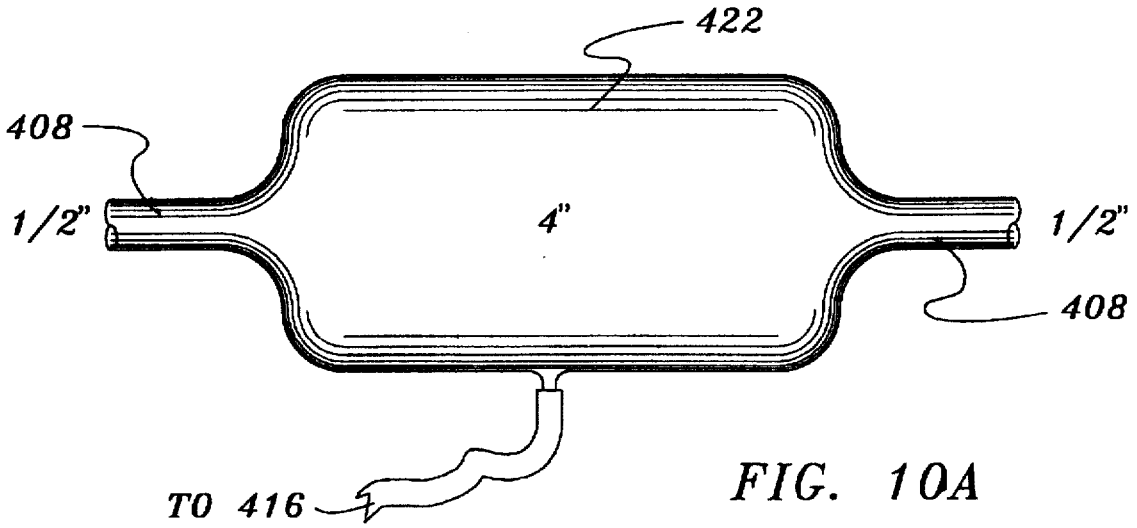
Figure 10B:
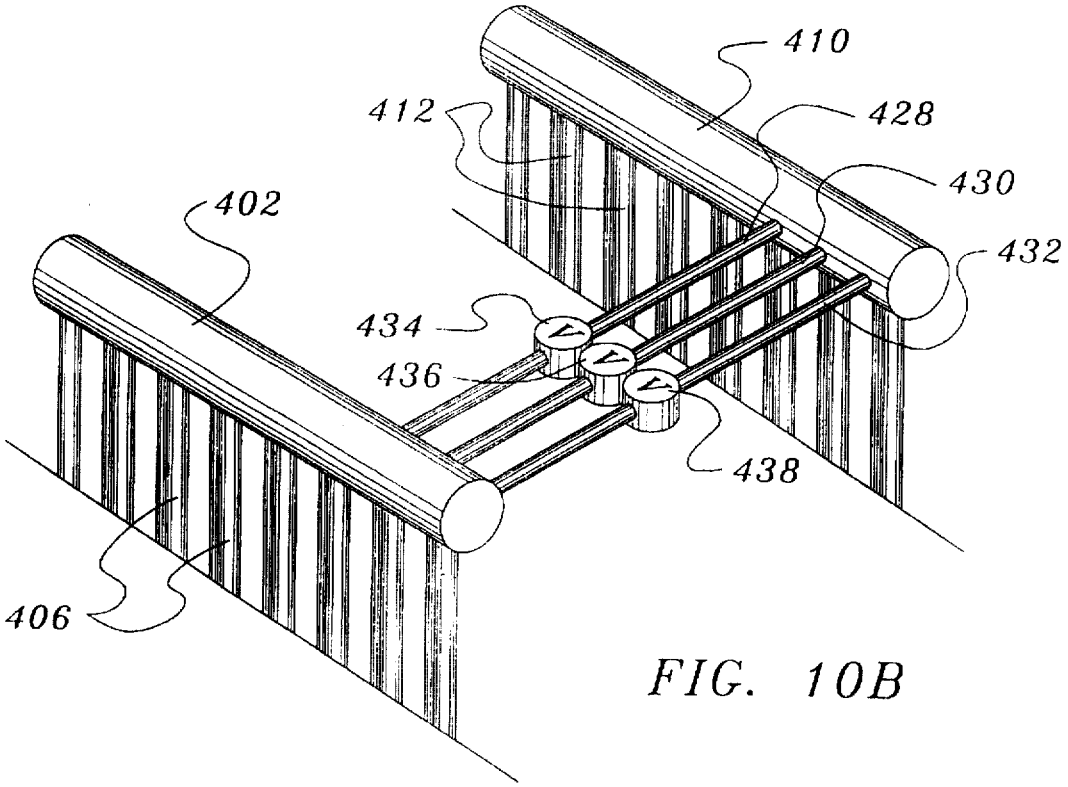

The next embodiment is illustrated in FIGS. 10, 10A and 10B. In this embodiment there is shown a wrap-around heat pipe 400. It includes an upper horizontal manifold 402 and a lower horizontal manifold 404 coupled by vertical pipes 406 for the upward flow of vapors therethrough. The vapors travel along coupling line 408 to the upper horizontal manifold 410, then down vertical condensing pipes 412 to a lower horizontal manifold 414. The fluid then flows through line 416 back to manifold 404 in a continuing cycle of operation. The manifolds 402, 404, and lines 406 are an evaporator while the manifolds 410 and 414 and lines 412 are a condenser. Flow is effected through heat pipe principles to pre-cool air prior to entering a cooling coil and to reheat the air after leaving the cooling coil. Within the line 408 is a flow control orifice 418 to set an upper heat transfer limit for the heat pipe. In addition, a valve 420 is located in the line 416 which is preferably a magnetically coupled valve to modulate the heat pipe from 0 percent to 100 percent.

A wrap-around heat pipe in the DX equipment for combining a wrap-around heat pipe with the sub cool and de-super heat reheat (SCADR) system, to enable the treatment of 100 percent outside air using DX equipment. Outside air is difficult to treat because of the variation in the heat load of the outside air. There is a simple way to treat outside air where the air would first flow through an evaporator heat pipe then through one or two cooling coils which have staged or multiple compressors connected and following that, the air flows through the condenser side of the heat pipe for the initial reheating and then through the sub cool and de-super heat reheat system coils again using loop one and loop two of the sub cool and de-super heat reheat system with the various combinations of direct sub-cooling and sub-cooling through the heat pipe. Finally, the air might flow through another coil which will be a heat pump coil, which is for winter heating or, in some cases, to add the last of supplemental reheat that might be needed to meet the discharge conditions economically using a heat pump.

An alternate embodiment of the FIG. 10 embodiment includes a velocity reduction member in the vapor line of the heat pipe formed as an expanded zone 422 in line 408. In a typical construction of such device, line 408 would be a ½ inch line while 422 had an increased diameter to about 4 inches. At the bottom of the expanded zone, a line 416 directs the liquid refrigerant entrained in the vapor to line 416 to the liquid line of the heat pipe. Such component 422 may be considered as a reverse Venturi which functions to enhance the performance of the wrap-around heat pipe. In this case, the wrap-around heat pipe has a dedicated vapor line or several vapor lines transferring the vapor from the evaporator heat pipe to the condenser heat pipe and then either one or multiple liquid lines return the liquid to the evaporator. In order to try to enhance the performance of the heat pipe and its heat transfer, added is an area in the vapor line which expands the diameter of the vapor line in order to decrease the velocity of the refrigerant vapor that is in the vapor line to cause the droplets of refrigerant at this lower velocity to drop out of the vapor and then return them through a line back into the liquid line near the bottom of the evaporator heat pipe. Line 408 may function with the Venturi component 422, and/or the flow control orifice 418. It also may function without either such components.

FIG. 10B shows a further alternate embodiment of the FIG. 10 embodiment. In such embodiment, lines 402 and 410 are coupled by three parallel lines 428, 430 and 432. Each capable of conveying one-third of the vapor from line 402 to line 410. Each of such lines, however, is provided with its own actuatable valve 434, 436 and 438. In operation and use, any one or more of such valves may be opened or closed at the discretion of the operator to open the associated line or lines. This will vary the amount of heat transfer of the heat pipe for any particular application.

Figure 11:
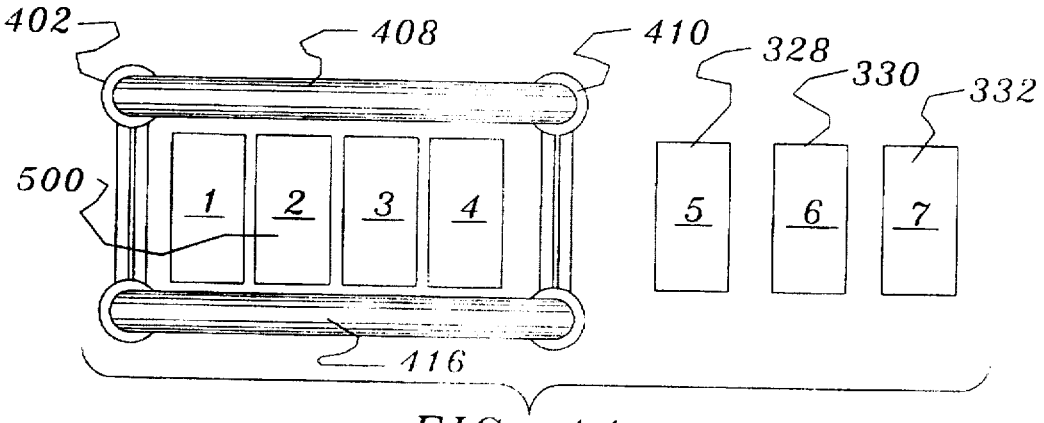

FIG. 11 is a schematic illustration of a system similar to that shown in FIG. 9. The FIG. 11 embodiment, however, adds a chilled water coil 500 to the system of FIG. 9. In the FIG. 9 embodiment as well as the FIG. 11 embodiment, there is an evaporator heat pipe 402 of the wrap-around heat pipe of FIG. 10. The chilled water coil 500 followed by the direct expansion (DX) evaporator 326, condenser heat pipe 410, the sub-cooling reheat coil 328, the de-super heat/reheat coil 330 and finally, the heat pump 332 in a general configuration for the flow of air therethrough as shown in FIG. 9.

Figure 11A:
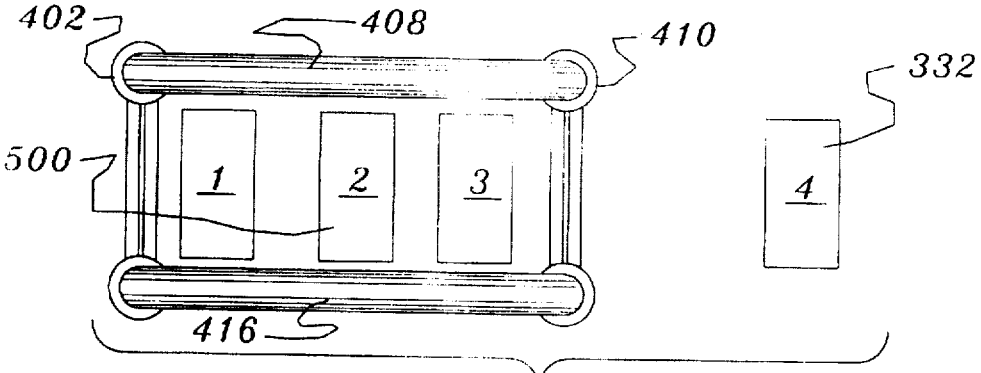

The FIG. 11A embodiment is identical to the embodiment of FIG. 11 except that there is removed the direct expansion evaporator 326 as well as the sub-cool reheat coil 328 and the de-super heat/reheat coil 330.

An alternate embodiment of the invention is shown in FIGS. 12, 12A, and 12B. These embodiments are similar to the embodiment of FIG. 9 except that an alternate wrap-around heat pipe is employed and the entire system for working fluid is fabricated of one coil having multiple rows. In the preferred embodiment the center rows are dedicated to being the cooling portion of the coil, being either direct expansion or chilled water and the outer one, two or three rows on each side are dedicated to the heat pipe. A coil like this is easy to fabricate and clean. More specifically, the modified heat pipe of FIG. 12 employs two rows of pipes on each side of the system. At the input end, the two rows of pipes are formed with horizontally stacked pipes. The same arrangement is at the output end of the system. The upper most pipe of each row at the input end is coupled by a horizontal coupling line coupling the upper most line at the output end. When two input rows and two output rows are utilized the interior most lines are coupled through a coupling line and the outer most lines are coupled through a cross line to create a counter current heat exchanger. Each line therebeneath is coupled by a cross line to make a generally U-shaped configuration, note FIG. 12. The other components between the input lines of the wrap-around heat pipe and the output lines may be as shown in the prior embodiments.

FIG. 12A is an illustration wherein only one row of pipes is at the input end of the wrap-around heat pipe and one row of pipes is at the output end. These are shown as rows 1 and 4 in the FIG. 12 embodiment. In addition, lines 2, 3, 5, 6 and 7 include only single rows of pipes. Rows 1 and 4 are coupled through horizontal lines with L-shaped bends coupling the input and output tubes of the rows. Coupling of the lines of the other rows 2, 3, 5, 6 and 7 are preferably vertically extending U-shaped joints. Lines 2, 3, 5, 6 and 7 represent the DX evaporation cooling coil 326, the sub cooling reheat coil 328, the de-super heat/reheat coil 330 and the heat pump 332.

FIG. 12B is similar of that of FIG. 12A except that the wrap-around heat pipe is formed with two rows of pipes at its input end and two rows of pipes at its output ends. These are schematically illustrated as lines 1 and 2 at the input end and lines 6 and 7 at the output end. Line 8 is the sub-cooling reheating line while line 9 is the de-super heat/reheat line. Lines 3, 4 and 5 are the direct expansion cooling line and the chilled water line. Lines 8 and 9 taken together are the SCADR.

In all of the embodiments of FIGS. 12, 12A, and 12B, the pipes are all fabricated as a single coil with common heat exchange fins coupling all of the pipes of the system. Note the schematic illustration of heat exchange fins in FIGS. 12 and 12A which are applied to the embodiment of FIG. 12B. Such heat exchange fins are located in vertical planes parallel with each other with apertures over the lines therethrough.

Figure 13A:
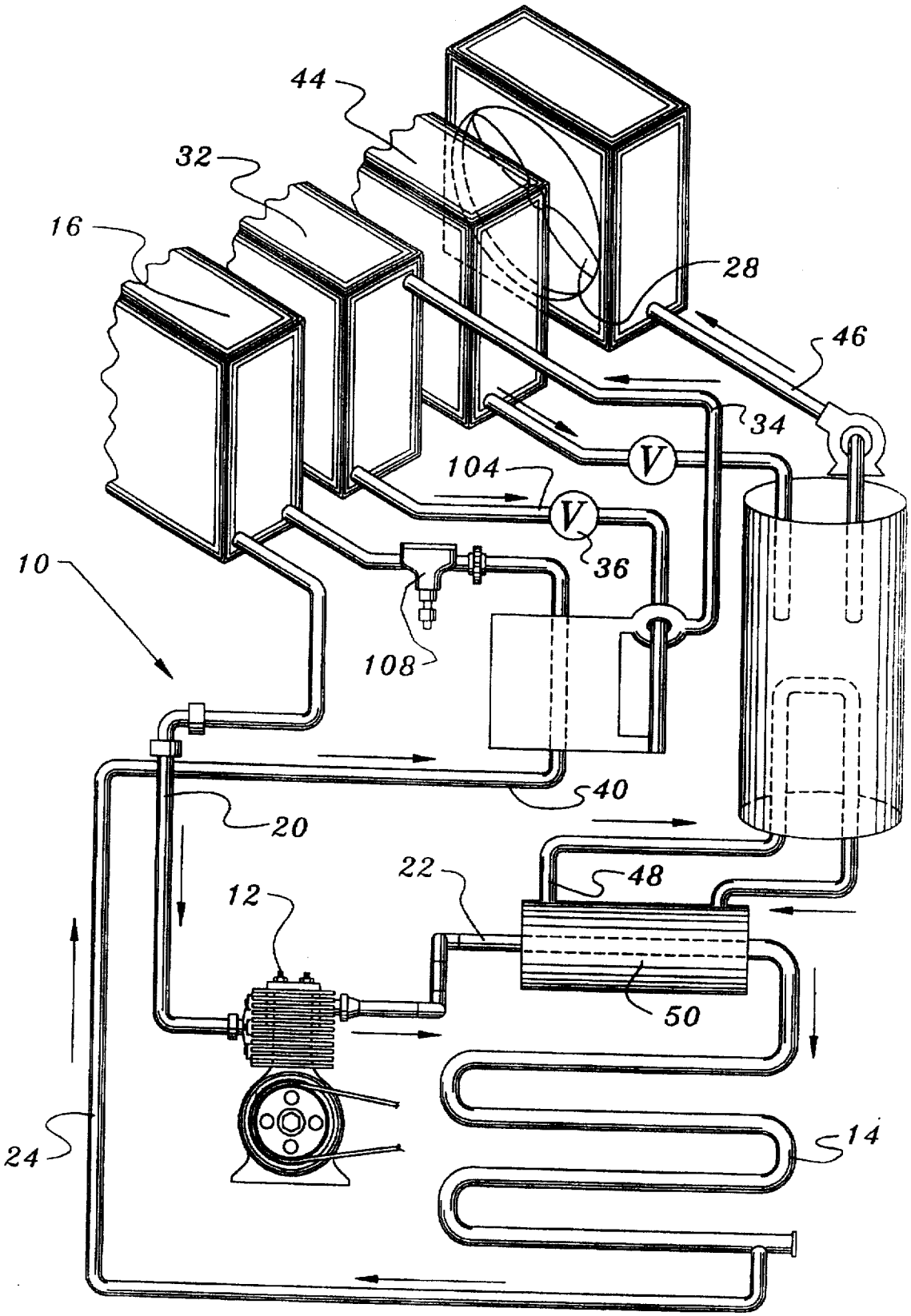

FIGS. 13 and 13A are similar to the embodiment of FIG. 3. In these embodiments, however, a hot water tank 800 for potable water is employed as the heat exchanger between the two loops for the refrigerant. In this case, an additional benefit of providing heat recovery to heat the potable water for the facility, in this case, a heat exchanger is used, just like loop two of the SCADR system. This use of the heat pipe process to transfer heat to a hot water tank 800 for water heating will benefit the user to get free hot water whenever the air conditioner ran, because the supplemental reheat is used infrequently, all heat can be pulled out of the hot water tank to supply the supplemental reheat and this can be accomplished through the heat pipe process, whereby the hot water tank would be the evaporator site of the heat pipe and the reheat coil 44 on the air handler making up loop 2 would be the condenser side of the heat pipe, or possibly by pumping hot water from the hot water tank 800 through a water coil in loop two's reheat position and then back to the hot water heater as depicted in FIG. 13A.

Now that the invention has been described,

What is claimed is:

1. An air conditioning system comprising a compressor, condenser and evaporator as functioning components in a primary loop for moving a working fluid in a continuous and automatic cycle of operation between such components, the system including a plurality of zones with cooling coils therebetween and through which a single linear flow of air to be conditioned is moved, the system also including a wrap-around heat pipe with first generally vertical parallel tubes with upper ends and lower end adjacent to the input of such zones and with second generally vertical parallel tubes with upper and lower ends adjacent to the output of such zones and upper and lower parallel horizontal lines with the upper line coupling the upper ends of the first and second parallel tubes and with the lower line coupling the lower ends of the first and second parallel tubes.

2. The system as set forth in claim 1 wherein the lines coupling the input include valves for varying the flow rate.

3. The system as set forth in claim 1 wherein the input and output include horizontal pipes.

4. The system as set forth in claim 1 and further including a flow control orifice.

5. The system as set forth in claim 1 and further including a magnetically coupled valve.

6. The system as set forth in claim 1 and further including a reverse Venturi.

* * * * *